US010458077B2

(12) United States Patent
Sorg et al.

(10) Patent No.: US 10,458,077 B2
(45) Date of Patent: Oct. 29, 2019

(54) VIBRATORY PLATE COMPACTOR WITH GRADING MEANS

(71) Applicant: Daniel Sorg, Qualicum Beach (CA)

(72) Inventors: Daniel Sorg, Qualicum Beach (CA); Robert Shaw, Qualicum Beach (CA)

( * ) Notice: Subject to any disclaimer, the term of this patent is extended or adjusted under 35 U.S.C. 154(b) by 137 days.

(21) Appl. No.: 15/505,161

(22) PCT Filed: Aug. 27, 2015

(86) PCT No.: PCT/CA2015/050824
§ 371 (c)(1),
(2) Date: Feb. 20, 2017

(87) PCT Pub. No.: WO2016/029317
PCT Pub. Date: Mar. 3, 2016

(65) Prior Publication Data

US 2017/0275831 A1 Sep. 28, 2017

Related U.S. Application Data

(60) Provisional application No. 62/043,288, filed on Aug. 28, 2014.

(51) Int. Cl.

| | |
|---|---|
| ***E01C 19/40*** | (2006.01) |
| ***E01C 19/20*** | (2006.01) |
| ***E02D 3/046*** | (2006.01) |
| ***E02F 3/76*** | (2006.01) |
| ***E02F 3/96*** | (2006.01) |

(Continued)

(52) U.S. Cl.
CPC ..... *E01C 19/40* (2013.01); *E01C 19/15* (2013.01); *E01C 19/20* (2013.01); *E01C 19/35* (2013.01); *E01C 19/402* (2013.01); *E02D 3/046* (2013.01); *E02F 3/7618* (2013.01); *E02F 3/967* (2013.01); *E01C 2019/206* (2013.01)

(58) Field of Classification Search
CPC ..... E01C 19/15; E01C 19/20; E01C 19/35; E01C 19/466; E01C 19/52; E01C 19/40; E01C 19/402
USPC ..... 404/133.1; 37/381
See application file for complete search history.

(56) References Cited

U.S. PATENT DOCUMENTS 3,357,745 A * 12/1967 Cooper ..... E01C 23/0933 299/39.3
3,806,269 A * 4/1974 Maass ..... E02D 3/074 404/113

(Continued)

FOREIGN PATENT DOCUMENTS

FR 2996865 A1 4/2014

OTHER PUBLICATIONS

Canadian Intellectual Property Office "Patent Cooperation Treaty International Search Report", dated Oct. 28, 2015, 2 pages.

*Primary Examiner* — Tara Mayo-Pinnock
(74) *Attorney, Agent, or Firm* — Tomlinson McKinstry, P.C.

(57) ABSTRACT

A grading blade for use with a plate compactor and a plate compactor having a grading blade, for use in grading base material when compacting. The grading blade is user movable relative to the plate compactor via a connection to a pivoting handle of the plate compactor or via a separate controller. The grading blade may be configured for use with a laser level and/or for remote control.

13 Claims, 15 Drawing Sheets

(51) Int. Cl.
*E01C 19/15* (2006.01)
*E01C 19/35* (2006.01)

(56) References Cited

U.S. PATENT DOCUMENTS

| | | | | | |
|---|---|---|---|---|---|
| 4,551,967 | A * | 11/1985 | Murcko | A01D 43/16 | 56/11.3 |
| 5,387,052 | A * | 2/1995 | Artzberger | E01C 19/38 | 192/105 BA |
| 6,394,697 | B1 * | 5/2002 | De Boer | E01C 19/38 | 404/133.05 |
| 2011/0016756 | A1 * | 1/2011 | Schmidt | E02F 3/325 | 37/403 |
| 2012/0251241 | A1 | 10/2012 | Sperfslage | | |

* cited by examiner

VIBRATORY PLATE COMPACTOR WITH GRADING MEANS

CROSS REFERENCE TO RELATED APPLICATIONS

This application claims the benefit of U.S. Provisional Patent Application No. 62/043,288, filed 28 Aug. 2014 and titled, VIBRATORY PLATE WITH OPERATOR CONTROLLED GRADING BLADE.

FIELD OF THE INVENTION

The present invention relates to the field of light equipment for use in compaction and more particularly vibratory plate compactors.

BACKGROUND OF THE INVENTION

In construction, sand, gravel, mixtures of same and other coarse particulate materials (generally referred to as "aggregate") are used as base material (at times herein referred to as "soil") to provide a stable foundation for an overlying feature, for example a concrete feature (e.g., a footing or slab), pavers etc.

When used, base material is generally compacted so as to reduce later settling/subsidence. It is also generally desirable to make the top surface of the base material flat and/or level, for example so as to be parallel to the top surface of a planar overlying feature. For example, a poured concrete slab gains strength and integrity from being uniform in thickness. To achieve this in the case of a slab poured on ground, the top of the base material must be made parallel to the planned top surface of the concrete slab. As well, making the ground parallel to the planned top surface of a concrete slab optimizes (in terms of cost) the amount of concrete used to make the slab.

Vibratory plate compactors are often used to compact base material. A vibratory plate compactor has a vibratory plate, an exciter component, a spring decoupling component and an upper mass comprising a motor (e.g. internal combustion engine) as a source of power to drive the exciter component, a cover and a structural frame. The exciter component is connected between the vibratory plate and the drive output of the motor, and the spring decoupling component is connected between the vibratory plate and the upper mass to permit the vibratory plate to vibrate relative to the upper mass. Typically, a plate compactor is configured such that the vibration tends to propel, or to assist in propelling, the compactor in a forward direction, while permitting the operator to move the plate compactor in the reverse direction or in other directions (e.g., side to side).

In many construction situations, when it is desirable to make the top surface of the base material flat and/or level, the ground is initially made roughly level/flat through the use of larger construction equipment. In most cases, the leveling achieved thereby is inadequate as there remain high and low spots that deviate from the desired plane.

Thus, when using a vibratory plate compactor to compact base material, it is usually necessary to hand level the base material, for example by using a landscaping rake or other such implement to remove base material from areas higher than the desired plane and apply base material to other areas lower than the desired plane. This is generally accomplished with a second worker while the compaction operation takes place.

The iterative process of compacting and leveling is time consuming because it requires repeated passes of compaction each time base material is moved from one location to another. It is also labour-intensive because the raking process generally involves removing base material from a high spot that has already been compacted.

SUMMARY OF THE INVENTION

In one aspect, the present invention provides a compactor for compacting soil, and having a vibratory plate and an upper mass connected to the vibratory plate and configured to provide vibrational movement of the vibratory plate relative to the upper mass, and having an operator handle for use in the directional control of the compactor, the improvement including: a grading blade mounted to the compactor; and an adjustment means for upward and downward adjustment of the grading blade.

The grading blade may be mounted to the upper mass via a mounting assembly including: two double-spar assemblies, one double-spar assembly on one side of the upper mass and the other double-spar assembly on an opposed side of the upper mass, each double-spar assembly including: an upper spar pivotally connected to the upper mass at an upper spar mass pivot and pivotally connected to the grading blade at an upper spar blade pivot; and a lower spar pivotally connected to the upper mass at a lower spar mass pivot and pivotally connected to the grading blade at an upper spar blade pivot, wherein each upper spar mass pivot, upper spar blade pivot, lower spar mass pivot and upper spar blade pivot, has a pivot axis and the pivot axes of one double-spar assembly are aligned with the pivot axes of the other double-spar assembly.

The grading blade has a front face and a tilt, the tilt being a general angular orientation of the front face relative to an imaginary plane defined by the vibratory plate; and the pivot axes may be located such that the pivot axes intersect an imaginary plane normal to the pivot axes, at locations substantially defining the four corners of a parallelogram, whereby, the tilt remains substantially the same through a range of available upward and downward adjustment of the grading blade.

The adjustment means may include a control device mounted to the operator handle and an interconnection between the control device and the grading blade. The interconnection between the control device and the grading blade may be a control cable.

The operator handle may be pivotally connected to the upper mass and the adjustment means may include a linkage between the operator handle and the grading blade, whereby pivoting the operator handle relative to the upper mass in one direction adjusts the grading blade upward and pivoting the operator handle relative to the upper mass in the other direction adjusts the grading blade downward.

The grading blade may be one of a straight blade, a serrated blade, a contained blade and a bucket blade. The grading blade may be pivotally mounted to one of the upper mass and the vibratory plate.

The compactor may be configured for use with a rotary laser level, wherein the compactor includes a sensor/display component having: a substantially vertical linear array of laser sensors; and a display configured to indicate whether a laser sensed by the laser sensors is above, below or sensed by a specified laser sensor.

The sensor/display component may be mounted to the grading blade; and the grading blade may be mounted to the upper mass via a mounting assembly including: two double-spar assemblies, one double-spar assembly on one side of the upper mass and the other double-spar assembly on an opposed side of the upper mass, each double-spar assembly including: an upper spar pivotally connected to the upper mass at an upper spar mass pivot and pivotally connected to the grading blade at an upper spar blade pivot; and a lower spar pivotally connected to the upper mass at a lower spar mass pivot and pivotally connected to the grading blade at an upper spar blade pivot, wherein each upper spar mass pivot, upper spar blade pivot, lower spar mass pivot and upper spar blade pivot, has a pivot axis and the pivot axes of one double-spar assembly are aligned with the pivot axes of the other double-spar assembly, the grading blade has a front face and a tilt, the tilt being a general angular orientation of the front face relative to an imaginary plane defined by the vibratory plate; and the pivot axes are located such that the pivot axes intersect an imaginary plane normal to the pivot axes, at locations substantially defining the four corners of a parallelogram, whereby: the tilt remains substantially the same through a range of available upward and downward adjustment of the grading blade; and the vertical array of laser sensors remains in a substantially consistent vertical orientation through the range of available upward and downward adjustment of the grading blade.

The adjustment means may include: a motor configured to effect upward and downward adjustment of the grading blade; and a receiver interconnected with the motor and configured for instructing the motor to effect upward and downward adjustment of the grading blade responsive to received signals.

The compactor may also include a remote control/transmitter, wherein the received signals are transmitted by the remote control/transmitter. The compactor may be configured for use with a rotary laser level, wherein: the receiver includes a substantially vertical linear array of laser sensors; and the received signals are sensed lasers, wherein in use: if a sensed laser is above a specified laser sensor, the receiver instructs the motor to make an upward adjustment of the grading blade; and if a sensed laser is below a specified laser sensor, the receiver instructs the motor to make a downward adjustment of the grading blade.

The grading blade has a front face and a tilt, the tilt being a general angular orientation of the front face relative to an imaginary plane defined by the vibratory plate, and the compactor may also include a tilt adjustment mechanism.

In another aspect, the present invention provides a compactor for compacting soil, and having a vibratory plate, an upper mass connected to the vibratory plate and an operator handle, and configured to provide vibrational movement of the vibratory plate relative to the upper mass, the improvement including: a grading blade mounted to the upper mass via a mounting assembly including: two double-spar assemblies, one double-spar assembly on one side of the upper mass and the other double-spar assembly on an opposed side of the upper mass, each double-spar assembly including: an upper spar pivotally connected to the upper mass at an upper spar mass pivot and pivotally connected to the grading blade at an upper spar blade pivot; and a lower spar pivotally connected to the upper mass at a lower spar mass pivot and pivotally connected to the grading blade at an upper spar blade pivot, wherein each upper spar mass pivot, upper spar blade pivot, lower spar mass pivot and upper spar blade pivot, has a pivot axis and the pivot axes of one double-spar assembly are aligned with the pivot axes of the other double-spar assembly, wherein: the grading blade has a front face and a tilt, the tilt being a general angular orientation of the front face relative to an imaginary plane defined by the vibratory plate; and the pivot axes are located such that the pivot axes intersect an imaginary plane normal to the pivot axes, at locations substantially defining the four corners of a parallelogram, whereby, the tilt remains substantially the same through a range of available upward and downward adjustment of the grading blade; an adjustment means comprising a control device mounted to the operator handle and an interconnection between the control device and one of the mounting assembly and the grading blade.

The forward motive force provided by a typical plate compactor is relatively small; a plate compactor can be readily held in place, or even reversed, manually by an operator. Thus, the effectiveness of the grading function provided by the present invention was unexpected. The inventors understand that the unexpected functionality arises at least in part by the vibration imparted to the grading blade by the plate compactor when in use. It is believed that this vibration "frees up" or dis-aggregates the base material contacted by the grading blade, reducing the force required to push the base material.

A skilled operator may be able to achieve acceptable results with any of the embodiments described herein. However, it is understood that a blade adjustment means actuated by pivoting of an operator handle requires greater operator coordination and skill than a blade adjustment means actuated by a separate control system. As well, a separate control system allows for use of cable, electric components (e.g., servo-motors) or hydraulically driven components. Thus, the inventors understand that for many users a preferred embodiment would incorporate a dedicated separate control system, e.g., a blade adjustment means not actuated by pivoting of an operator handle. As well, the inventors also understand that a preferred embodiment would incorporate a double spar mounting assembly (so as to maintain consistent blade tilt) as this configuration is suitable for mounting a laser receiver on the grading blade.

DETAILED DESCRIPTION WITH REFERENCE TO THE DRAWINGS

Figure 1:
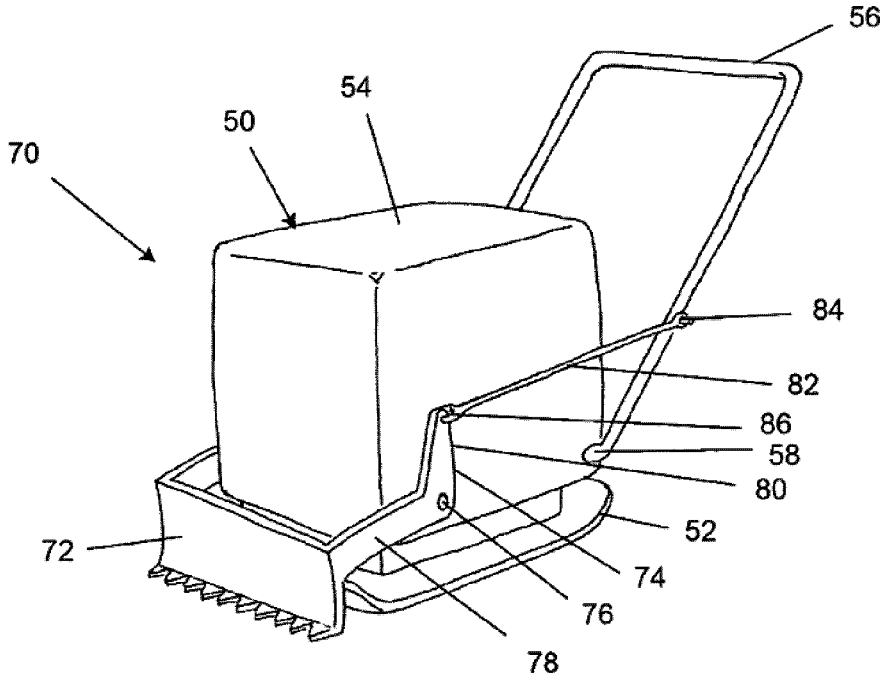
FIG. 1 is a perspective view of an upper-mass-mounted handle-linked embodiment of the present invention, with the grading blade shown in a lowered position.

As indicated in the drawings, each embodiment of the present invention includes a vibratory plate compactor 50 comprising a vibratory plate 52, an upper mass 54 and an operator handle 56 (or fixed handle 332). To simplify the drawings, the upper mass 54 is shown in a stylized manner, i.e., as a regular, essentially featureless, rectangular housing. As set out above, the vibratory place compactor 50 also includes additional features not indicated in the drawings, being the exciter component, spring decoupling component and drive motor. A vibratory plate compactor 50 also typically includes a vibration speed control (also not shown in the drawings) mounted to the operator handle 56. Usually, the drive motor is a gasoline engine and the vibration speed control is a throttle.

As indicated in the drawings, the operator handle 56 is typically a generally U-shaped bar (or tube) with each arm of the U pivotally attached to the upper mass 54 at opposed handle pivots 58. In use, the operator holds the operator handle and uses it to direct the vibratory plate compactor 50. Although, a vibratory plate compactor 50 may be moved in different directions, in use the operator typically walks behind a vibratory plate compactor 50 and in use the operator handle 56 is at the rear of the vibratory plate compactor 50 in terms of the dominant direction of travel. Thus, at times herein, the terms, front, rear, forward and rearward are used with respect to the vibratory plate compactor 50.

Figure 2:
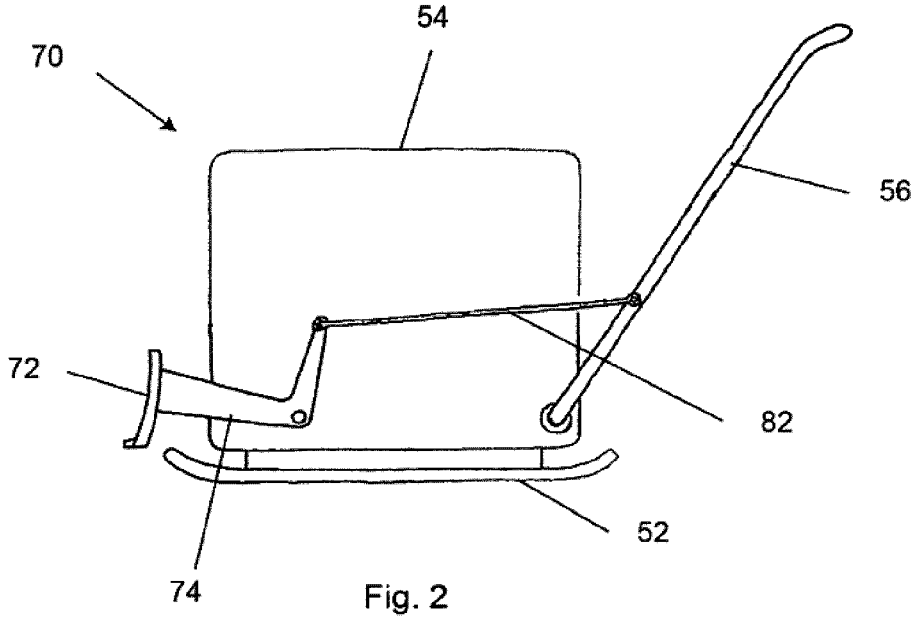
FIG. 2 is a side elevation view of the embodiment of FIG. 1, with the grading blade shown in a raised position.

FIGS. 1 and 2 show a mass-mounted handle-linked embodiment 70 of the present invention, having a grading blade 72 extending across the front of the vibratory plate compactor 50, i.e., at the end opposite the operator handle 56. The grading blade 72 is affixed to two spaced-apart parallel V-members 74. In the vicinity of the base of each V, the V-members 74 are pivotally mounted to the upper mass 54 at opposed blade-mass pivots 76. Each V-member 74 includes: a V-member blade arm 78 extending between the grading blade 72 and the blade-mass pivot 76; and a link arm 80 extending generally upward from the blade-mass pivot 76. A pole 82 extends between, and is pivotally connected to each of, the link arm 80 (at the link-pole pivot 84 and the operator handle 56 (at the handle-pole pivot 86).

As indicated in FIGS. 1 and 2, in use the operator may raise and lower the grading blade 72 by pivoting the operator handle 56 forward to lower the grading blade 72 and pivoting the operator handle 56 rearward to raise the grading blade 72.

As the user would in any case be holding the operator handle 56 to direct the vibratory plate compactor 50, using the operator handle 56 to also control the height of the grading blade 72, enables the user to dynamically adjust the height of the grading blade 72 without shifting his or her hands.

It will be apparent that the relative movement as between the operator handle 56 and grading blade 72 may be adjusted by moving the link-pole pivot 84 and the handle-pole pivot 86. For example, moving the link-pole pivot 84 towards the blade-mass pivots 76 will increase the relative movement of the grading blade 72, and moving the handle-pole pivot 86 towards the handle pivot 58 will decrease the relative movement of the grading blade 72. The upper-mass-mounted handle-linked embodiment 70 may be configured with a designer-defined single relative movement as between of the operator handle 56 and grading blade 72. Alternatively, the upper-mass-mounted handle-linked embodiment 70 may be configured so as to enable the user to modify the relative movement as between the operator handle 56 and grading blade 72, by for example, providing: alternative pivot connection locations on either or both of the link arm 80 and operator handle 56. Such alternative pivot connections could be located along an arc so as to be usable with a pole 82 of the same length. Alternatively, the length of the pole 82 could be adjustable or the pole 82 could have additional attachment locations along its length.

Figure 3:
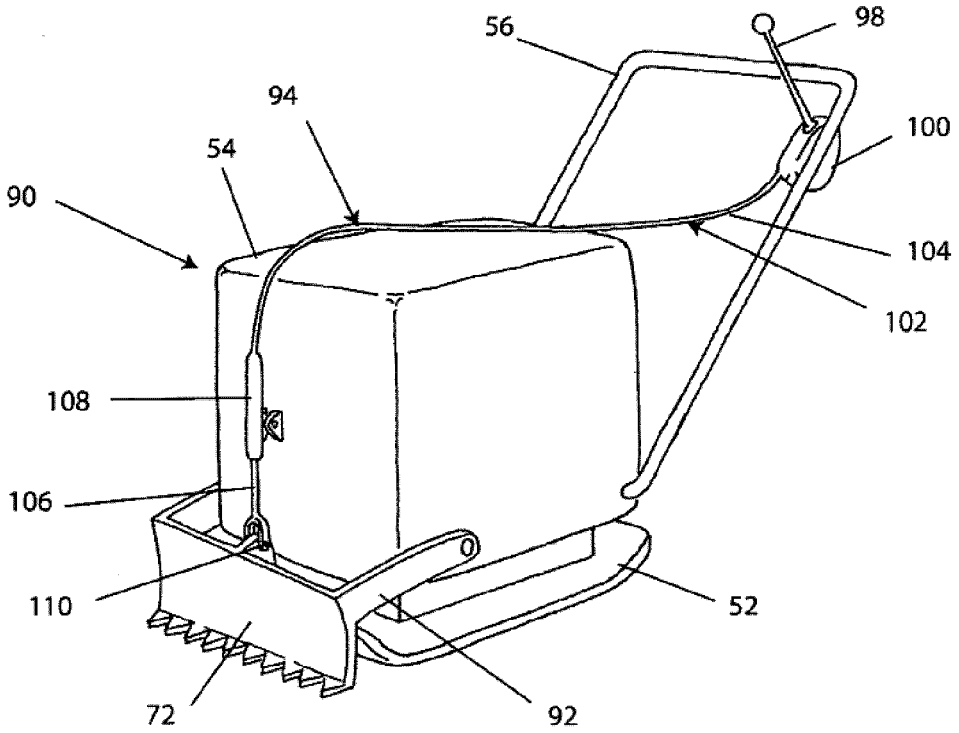
FIG. 3 is a perspective view of an upper-mass-mounted push-pull-cable embodiment of the present invention, with the grading blade shown in a lowered position.
Figure 4:
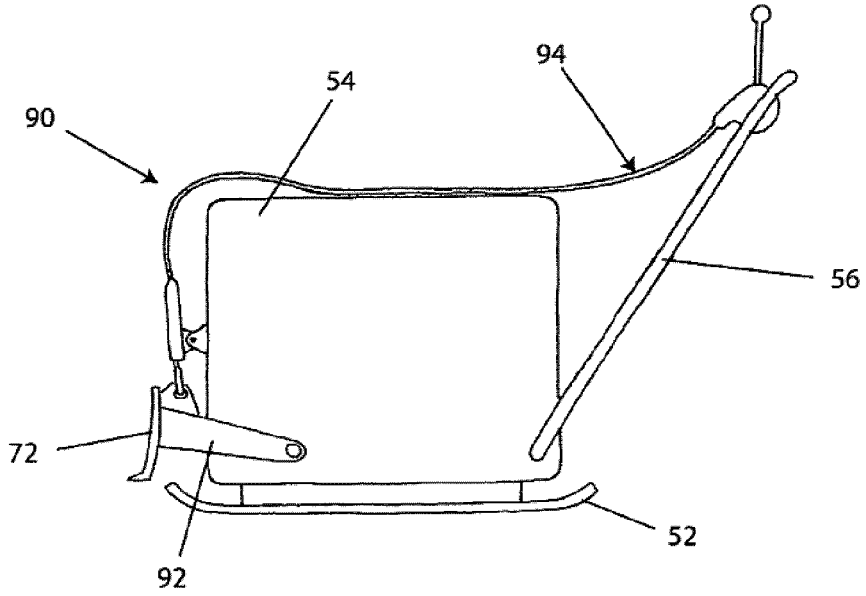
FIG. 4 is a side elevation view of the embodiment of FIG. 3, with the grading blade shown in a raised position.

FIGS. 3 and 4 show an upper-mass-mounted push-pull-cable embodiment 90 of the present invention, having a grading blade 72 extending across the front of the vibratory plate compactor 50, i.e., at the end opposite the operator handle 56. The grading blade 72 is affixed to two spaced-apart parallel blade arms 92, which are pivotally mounted to the upper mass 54 at opposed blade-mass pivots 76.

The upper-mass-mounted push-pull-cable embodiment 90 includes a control cable assembly 94, which includes: a cable controller 96 (shown in the drawings as comprising a control lever 98 and a cable actuating hub 100; alternative push pull cable controller configurations could be used); a push pull cable 102 (also referred to as a confined cable) comprising an outer tube 104 and an inner flexible rod 106; a cable clamp 108; and a rod terminal 110. As indicated in the drawings, the cable controller 96 is mounted on the operator handle 56, the rod terminal 110 is attached to the grading blade 72 in the vicinity of the middle of the grading blade 72, and the push pull cable 102 extends from the controller 96 to the rod terminal 110, with the outer tube 104 in the vicinity of the rod terminal 110 affixed to the upper mass 54 by way of the cable clamp 108.

As indicated in FIGS. 3 and 4, with the upper-mass-mounted push-pull-cable embodiment 90, the operator may lower the grading blade 72 by moving the control lever 98 in one direction and raise the grading blade 72 by moving the control lever 98 in the opposite direction.

Figure 5:
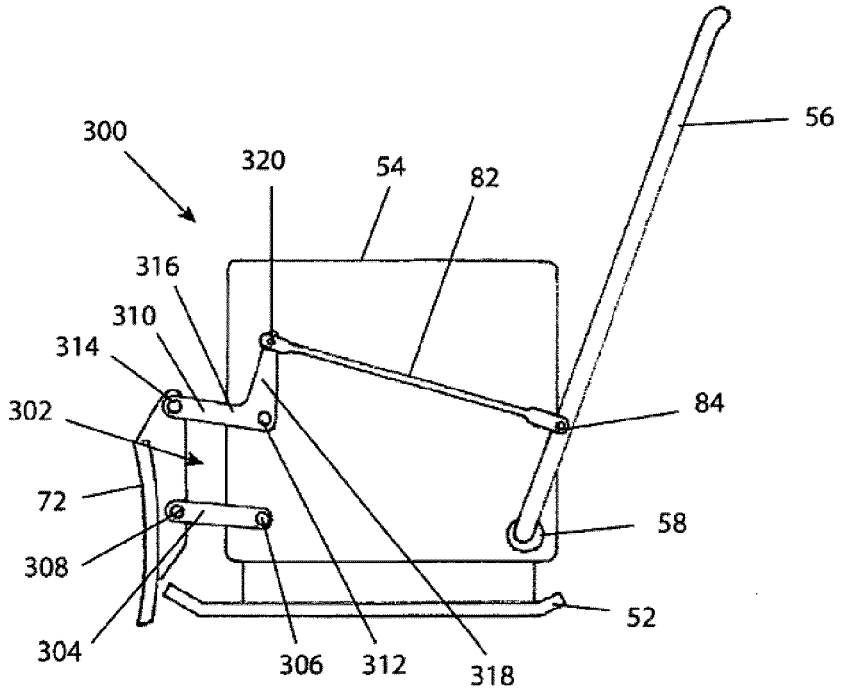
FIG. 5 is a side elevation view of an upper-mass-mounted double-spar handle-linked embodiment of the present invention, with the grading blade shown in a lowered position.
Figure 6:
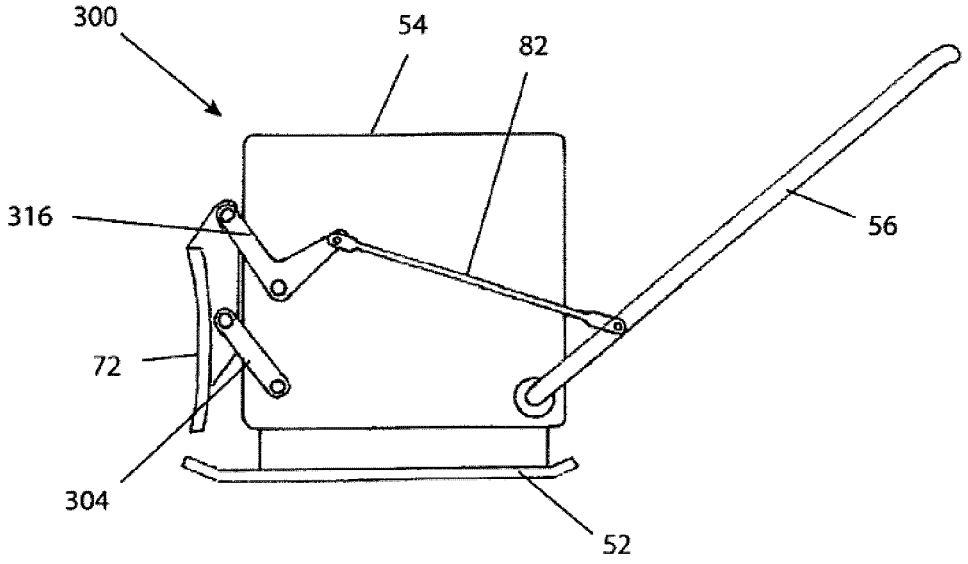
FIG. 6 is a side elevation view of the embodiment of FIG. 5, with the grading blade shown in a raised position.

FIGS. 5 and 6 show an upper-mass-mounted double-spar handle-linked embodiment 300 of the present invention, having a grading blade 72 extending across the front of the vibratory plate compactor 50, i.e., at the end opposite the operator handle 56. The upper-mass-mounted double-spar handle-linked embodiment 300 includes a double-spar mounting assembly 302 comprising, on each side of the vibratory plate compactor 50: a lower spar 304, one end of which is pivotally mounted to the upper mass 54 at the lower-spar-mass pivot 306 and the other end of the which is pivotally connected to the grading blade 72 at the lower-spar-blade pivot 308; and an upper spar 310, pivotally mounted to the upper mass 54 at the upper-spar-mass pivot 312 and pivotally connected to the grading blade 72 at the upper-spar-blade pivot 314. One of the upper spars 310, the upper V-spar 316, further includes a V-spar-link arm 318 extending generally upward from the upper-spar-mass pivot 312. In the vicinity of the upper end of the V-spar-link arm 318 there is a V-spar-link-arm connector 320.

A pole 82 extends between, and is pivotally connected to each of, the V-spar-link-arm connector 320 and the operator handle 56 (at the handle-pole pivot 86). As indicated in FIGS. 5 and 6, in use the operator may raise and lower the grading blade 72 by pivoting the operator handle 56 forward to lower the grading blade 72 and pivoting the operator handle 56 rearward to raise the grading blade 72.

Figure 7:
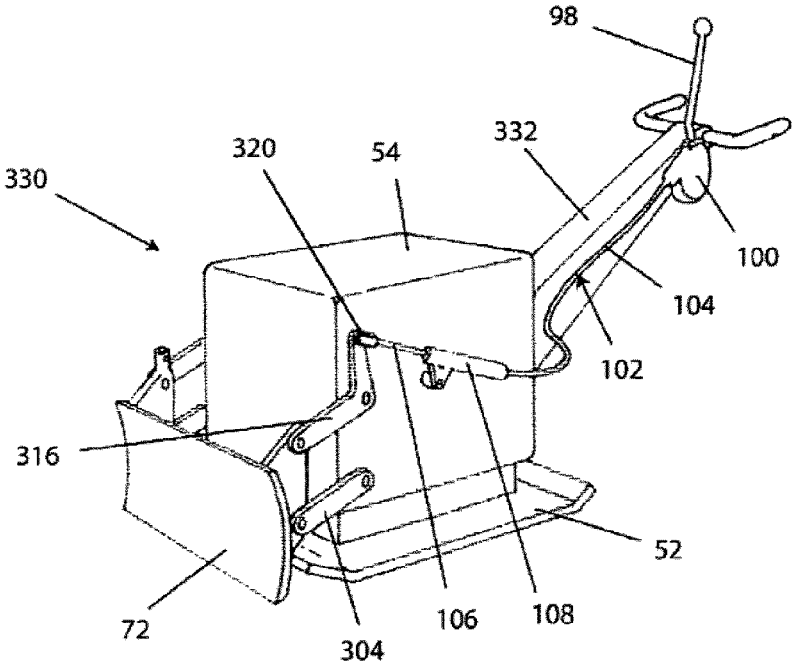
FIG. 7 is a perspective view of an upper-mass-mounted double-spar push-pull-cable embodiment of the present invention, with the grading blade shown in a lowered position.
Figure 8:
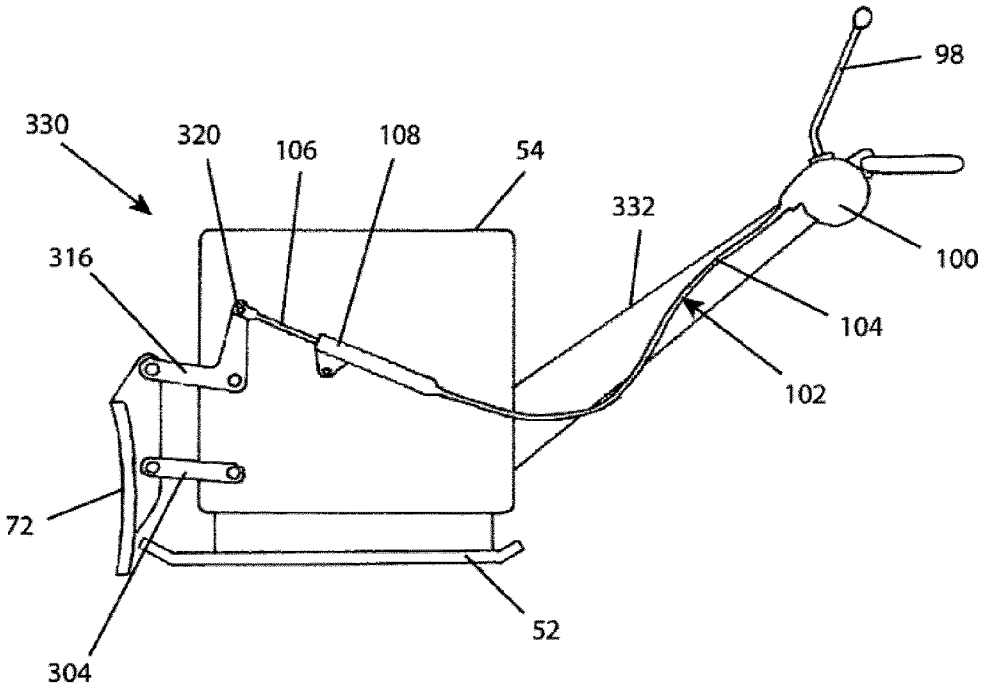
FIG. 8 is a side elevation view of the embodiment of FIG. 7.

FIGS. 7 and 8 show an upper-mass-mounted double-spar push-pull-cable embodiment 330 of the present invention shown in use with a vibratory plate compactor 50 having a fixed handle 332, i.e., a handle that, when the vibratory plate compactor 50 is in use, does not pivot. The upper-mass-mounted double-spar push-pull-cable embodiment 330 includes a double-spar mounting assembly 302 and a cable assembly 94 wherein the rod terminal 110 is connected to the V-spar-link-arm connector 320.

As indicated in FIGS. 7 and 8, with the upper-mass-mounted double-spar push-pull-cable embodiment 330, the operator may lower the grading blade 72 by moving the control lever 98 in one direction and raise the grading blade 72 by moving the control lever 98 in the opposite direction.

Figure 9:
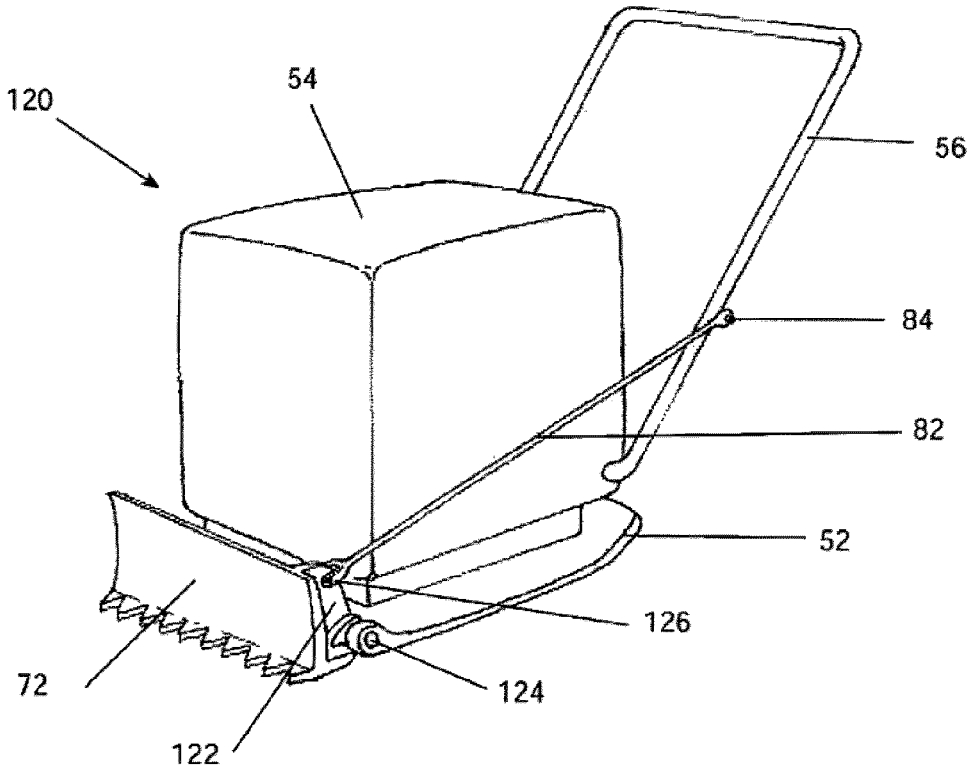
FIG. 9 is a perspective view of a plate-mounted handle-linked embodiment of the present invention, with the grading blade shown in a lowered position.
Figure 10:
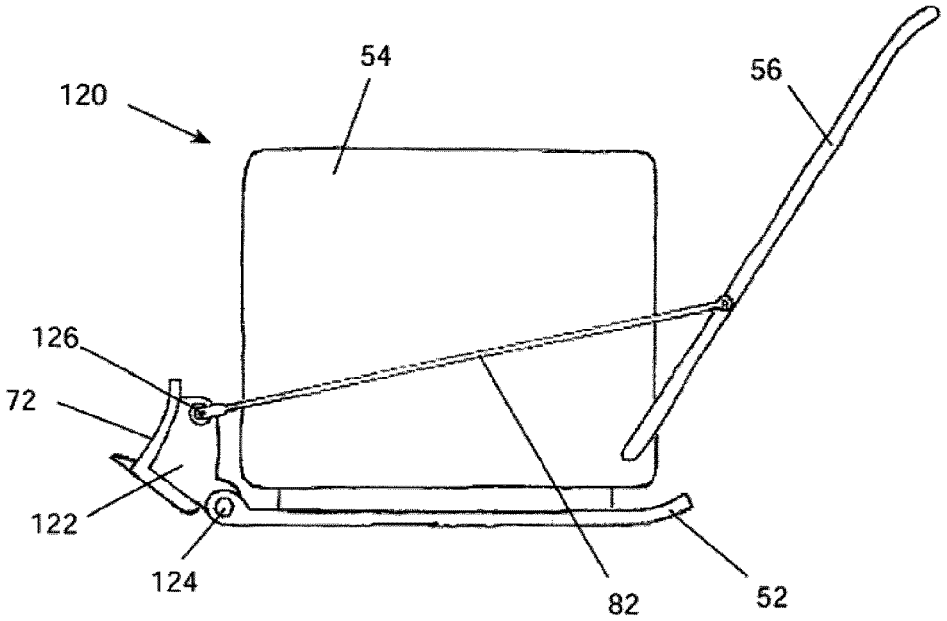
FIG. 10 is a side elevation view of the embodiment of FIG. 9, with the grading blade shown in a raised position.

FIGS. 9 and 10 show a plate-mounted handle-linked embodiment 120 of the present invention, having a grading blade 72 extending across the front of the vibratory plate compactor 50, i.e., at the end opposite the operator handle 56. The grading blade 72 is affixed to two spaced-apart blade flanges 122, which are pivotally mounted to the to the vibratory plate 52 (in the vicinity of the front end of the vibratory plate 52) at opposed flange-plate pivots 124. A pole 82 extends between, and is pivotally connected to each of, the blade flange 122 (at the flange-pole pivot 126 and the operator handle 56 (at the handle-pole pivot 86).

As indicated in FIGS. 9 and 10, in use the operator may raise and lower the grading blade 72 by pivoting the operator handle 56 forward to lower the grading blade 72 and pivoting the operator handle 56 rearward to raise the grading blade 72.

Figure 11:
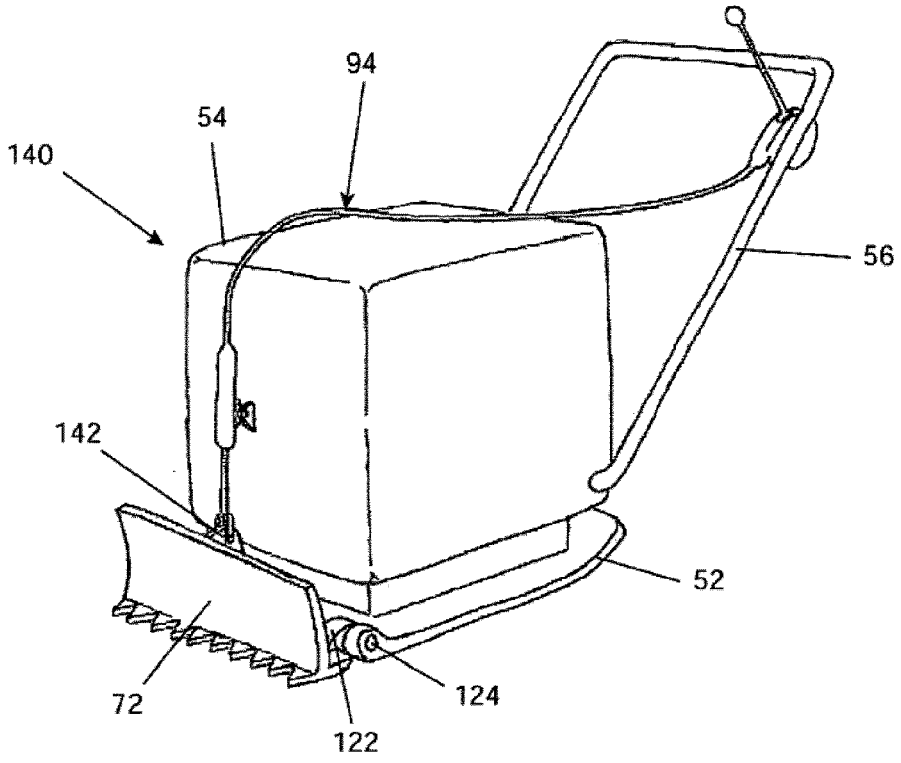
FIG. 11 is a perspective view of a plate-mounted push-pull-cable embodiment of the present invention, with the grading blade shown in a lowered position.
Figure 12:
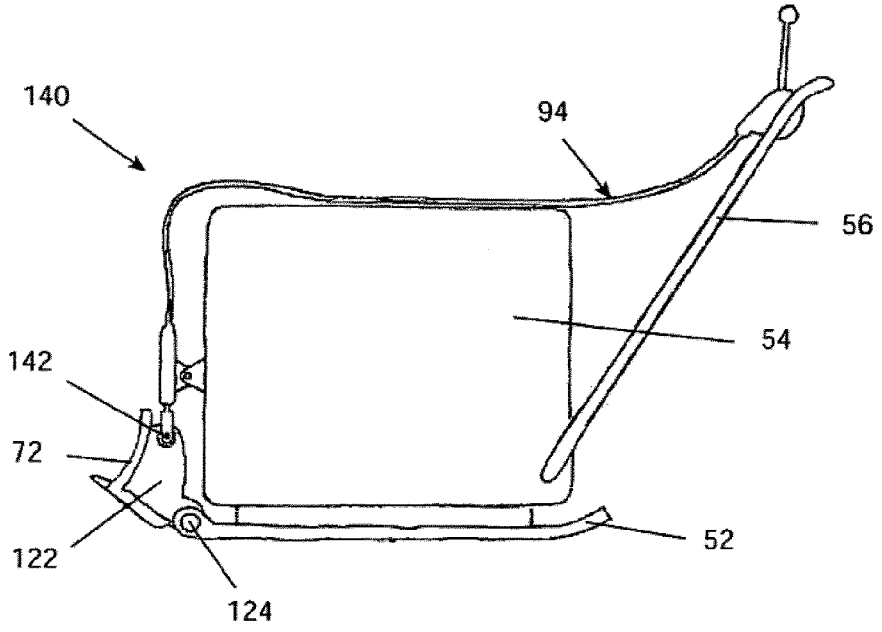
FIG. 12 is a side elevation view of the embodiment of FIG. 11, with the grading blade shown in a raised position.

FIGS. 11 and 12 show a plate-mounted push-pull-cable embodiment 140 of the present invention, having a grading blade 72 extending across the front of the vibratory plate compactor 50, i.e., at the end opposite the operator handle 56. The grading blade 72 is mounted to the vibratory plate 52 via blade flange 122 and flange-plate pivot 124 (as previously described). Affixed to the grading blade 72 in the vicinity of the middle of the grading blade 72, there is a connector plate 142 in the vicinity of the middle of the grading blade comprising a connection to the rod terminal 110. The plate-mounted push-pull-cable embodiment 140 includes a cable assembly 94 (as previously described).

As indicated in FIGS. 11 and 12, with the plate-mounted push-pull-cable embodiment 140, the operator may lower the grading blade 72 by moving the control lever 98 in one direction and raise the grading blade 72 by moving the control lever 98 in the opposite direction.

Figure 13:
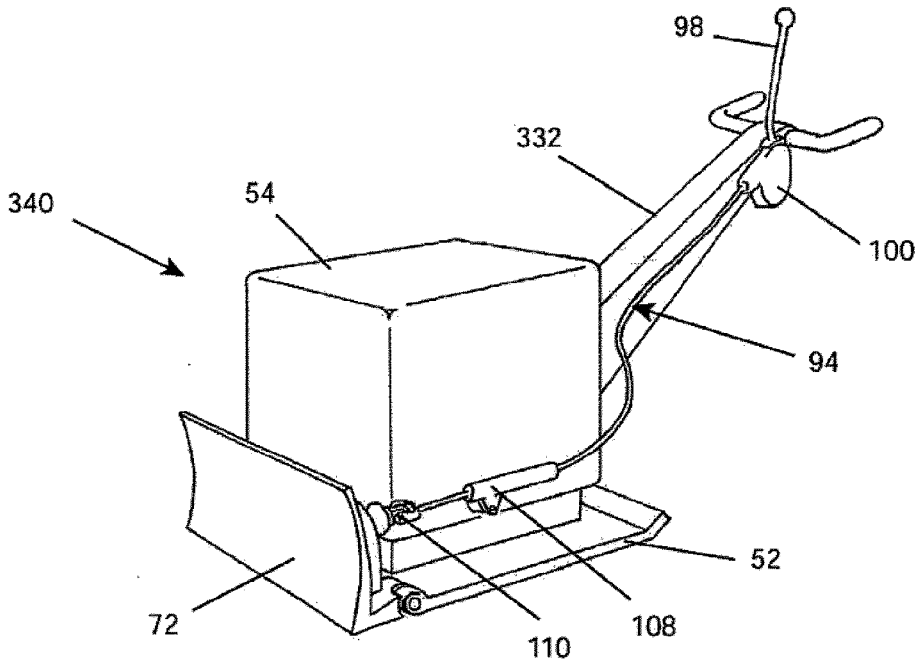
FIG. 13 is a perspective view of a plate-mounted side-push-pull-cable embodiment of the present invention.

FIG. 13 shows a plate-mounted side-push-pull-cable embodiment 340 of the present invention, in which the rod terminal 110 is connected to an end of the grading blade 72 and the cable clamp 108 is mounted to a side of the upper mass 54.

Figure 14:
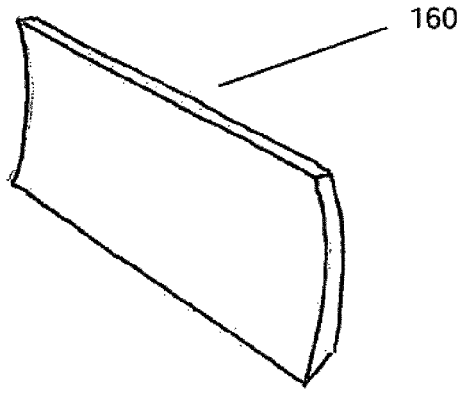
FIG. 14 is a perspective view of a straight blade suitable for use with embodiments of the present invention.
Figure 15:
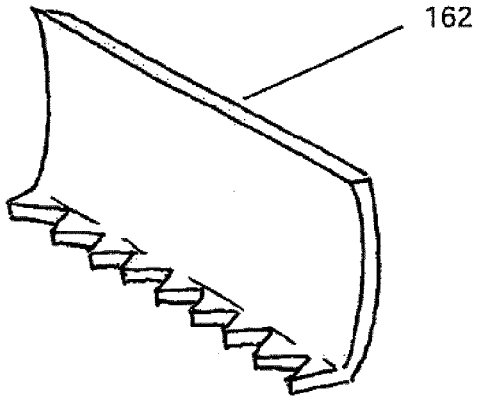
FIG. 15 is a perspective view of a serrated blade suitable for use with embodiments of the present invention.
Figure 16:
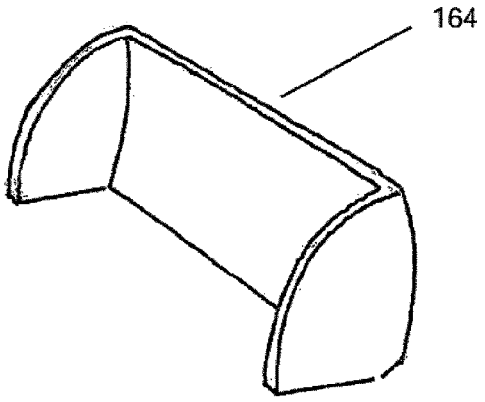
FIG. 16 is a perspective view of a contained blade suitable for use with embodiments of the present invention.
Figure 17:
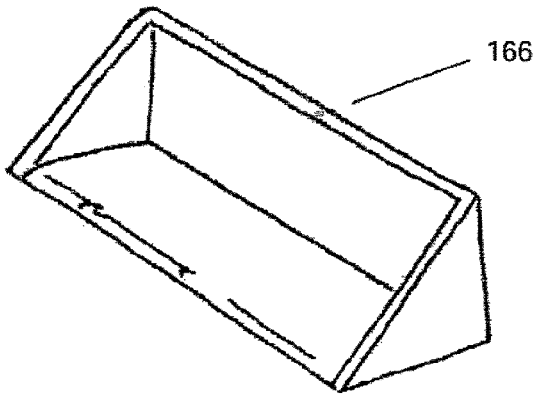
FIG. 17 is a perspective view of a bucket blade suitable for use with embodiments of the present invention.

FIGS. 14-17 show different types of grading blades 72 suitable for use with embodiments of the present invention. FIG. 14 shows a straight blade 160. FIG. 15 shows a serrated blade 162, having a serrated (or "toothed") lower edge. FIG. 16 shows a contained blade 164 having side containment members. FIG. 17 shows a bucket blade 166 having a "bucket" defined by side containment members and a bottom containment member.

Figure 18:
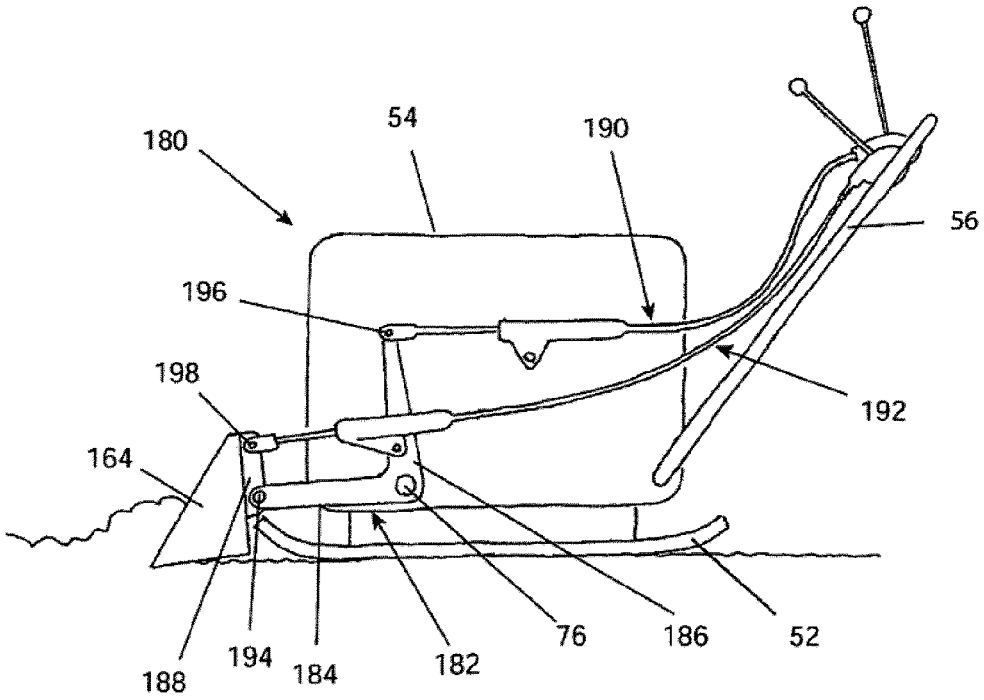
FIG. 18 is a side elevation view of an upper-mass-mounted push-pull-cable tilt-blade embodiment of the present invention.

The upper-mass-mounted push-pull-cable blade-tilt embodiment 180 of the present invention shown in FIG. 18 comprises: a tilt-action V-member 182 pivotally mounted to the upper mass 54 at a blade-mass pivot 76 (as described above with respect to the V-member 74) and having a tilt-action blade arm 184 and tilt-action link arm 186; a bucket blade 166 having a tilt flange 188 affixed thereto; and two cable assemblies 94, being a raise/lower cable assembly 190 and a tilt cable assembly 192. The bucket blade 166 is pivotally attached to the distal end of the tilt-action blade arm 184 at a bucket-blade pivot 194 located in the tilt flange 188. The raise/lower cable assembly 190 extends from the operator handle 56 to the distal end of the tilt-action link arm 186 to which it is pivotally connected at the cable-arm terminal 196. The cable clamp 108 of the raise/lower cable assembly 190 affixes the outer tube 104 of the raise/lower cable assembly 190 to the upper mass 54. The tilt cable assembly 192 extends from the operator handle 56 to the upper portion of the tilt flange 188 to which it is pivotally connected at the cable-flange terminal 198. The cable clamp 108 of the tilt cable assembly 192 affixes the outer tube 104 of the tilt cable assembly 192 to the tilt-action link arm 186 at a location between the blade-mass pivot 76 and the cable-arm terminal 196.

The upper-mass-mounted push-pull-cable tilt-blade embodiment 180 enables the operator to independently raise and lower, and tilt, the bucket blade 166 in a manner akin to the raising and lowering, and tilting, of the bucket of a front-end loader. The operator can collect soil from the ground surface in one location, contain the soil by tilting and raising the bucket blade 166 and then deposit the soil elsewhere by tilting the bucket blade 166.

As well, the upper-mass-mounted push-pull-cable tilt-blade embodiment 180 enables the operator to alter the aggressiveness of the scraping/grading function of the grading blade 72, whether the bucket blade 166 or another type of grading blade 72 (e.g., the straight blade 160, serrated blade 162, contained blade 164 etc.), by adjusting the tilt and thus the angle at which the bottom/leading edge of the grading blade 72 contacts the soil.

The ability of the operator to independently raise and lower, and tilt, the grading blade 72 provided by the upper-mass-mounted push-pull-cable tilt-blade embodiment 180 could also be obtained with alternative embodiments. Either the tilting, or the raising and lowering (though not both) could be provided in a manner akin to the previously described handle-linked arrangements, in that a pole 82 could connect the operator handle 56 to either the tilt-action link arm 186 or the tilt flange 188 (in a manner akin to the cable-flange terminal 198), in each instance, with a cable assembly 94 connected to the other of these features. With the former, the operator would use the operator handle 56 to raise and lower the grading blade 72 and use the cable assembly 94 to tilt the grading blade 72. With the latter, the operator would use the cable assembly 94 to raise and lower the grading blade 72 and use the operator handle 56 to tilt the grading blade 72.

Figure 19:
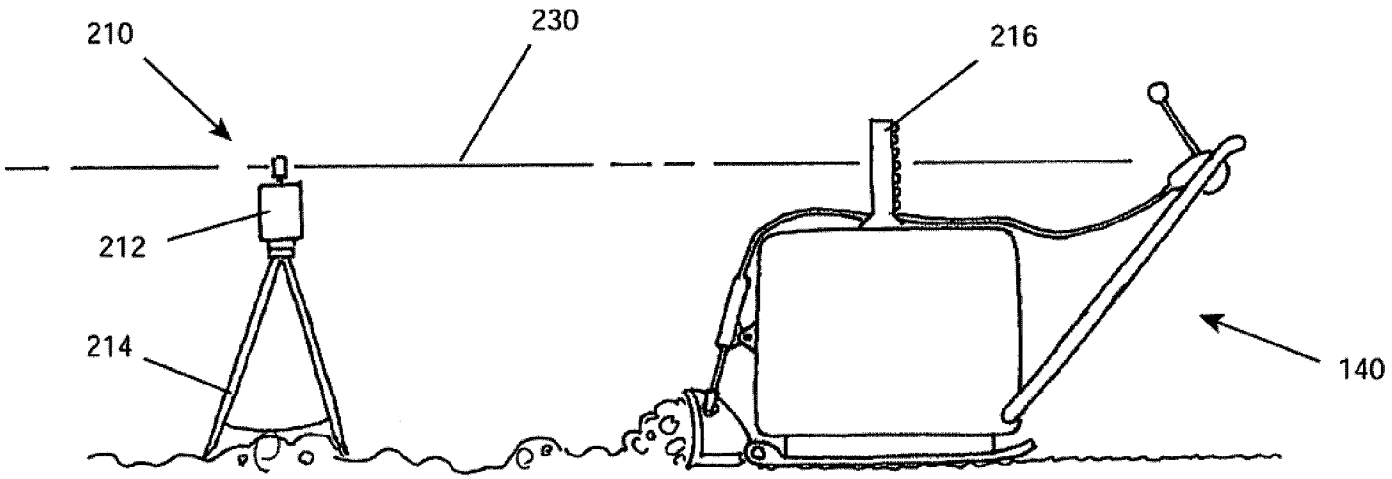
FIG. 19 is a schematic representation of a laser level guidance system for use with embodiments of the present invention.
Figure 20:
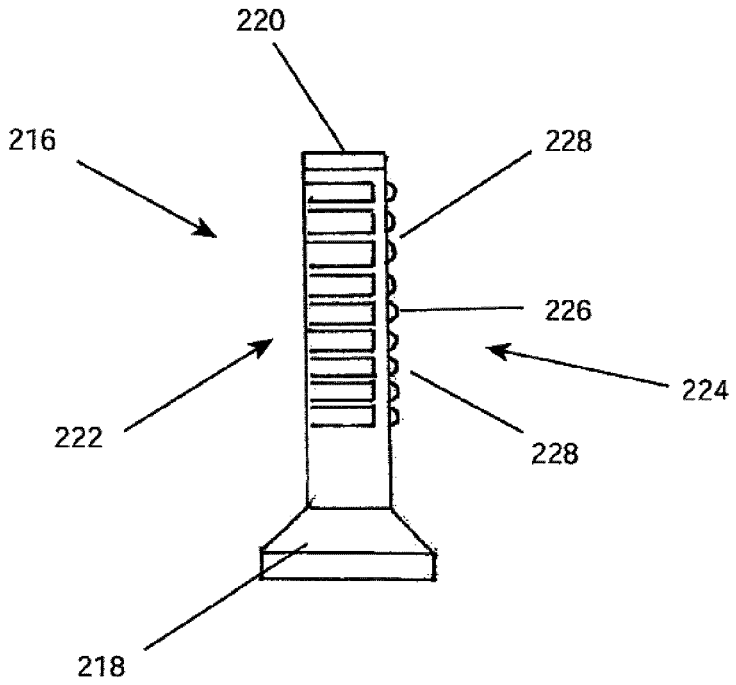
FIG. 20 is an isolation view of the sensor/display component of the laser level guidance system shown in FIG. 19.

FIGS. 19 and 20 show a level guidance system 210, comprising: a conventional rotary laser level 212, shown in FIG. 19 mounted on a conventional survey tripod 214; and a sensor/display component 216. The sensor/display component 216 comprises: a vibration-dampening base 218 (shown in FIG. 19 mounted to the upper mass 54 but which could alternatively be mounted to the grading blade 72 or the vibratory plate 52); and a vertical member 220 having an array of laser sensors 222 and a display 224.

An array of laser sensors 222 spanning a vertical distance of about 12 inches is understood to provide a usable range of height differences. The vertical spacing of the sensors in the array of laser sensors 222 may be consistent (i.e., the spacing may be same between each adjacent sensor in the array of laser sensors 222). Alternatively, the vertical spacing of the sensors in the array of laser sensors 222 may vary. For example, the spacing of the sensors at the bottom and top of the array of laser sensors 222 may be greater than the spacing of the sensors about the middle of the array of laser sensors 222, so as to provide greater sensitivity about the middle array of laser sensors 222 (that is, proximate the desired grade).

The display 224 shown in the drawings comprises a vertical array of coloured lights, being a central green light 226 and red lights 228 above and below the green light 226. The array of laser sensors 222 and display 224 are interconnected such that when a selected sensor (typically the middle sensor in the array of laser sensors 222) detects the laser beam 230 emitted by the rotary laser level 212, the green light 226 is illuminated, and when a sensor other than the selected sensor detects the laser beam emitted by the rotary laser level 212, then one or more of the red lights 228 is illuminated to indicate whether the soil supporting the vibratory plate compactor 50 is above or below the desired grade and by how much. It will be apparent that the display 224 could take different forms, including a display screen with coloured fields/bars akin to the green light 226 and red lights 228, a display screen with icons etc.

As is conventional, the height above the desired grade of the laser beam 230 emitted by the rotary laser level 212 may be adjusted by using the telescopic feature of the tripod 214 in combination with the conventional fine height adjustment of the mount of the rotary laser level 212. As well, the vertical member 220 may include means (not shown) for adjusting the height of the array of laser sensors 222 relative to the vibration-dampening base 218.

In use, the operator raises or lowers the grading blade 72 responsive to the indications of vertical distance above or below the desired grade provided by the display 224.

Figure 21:
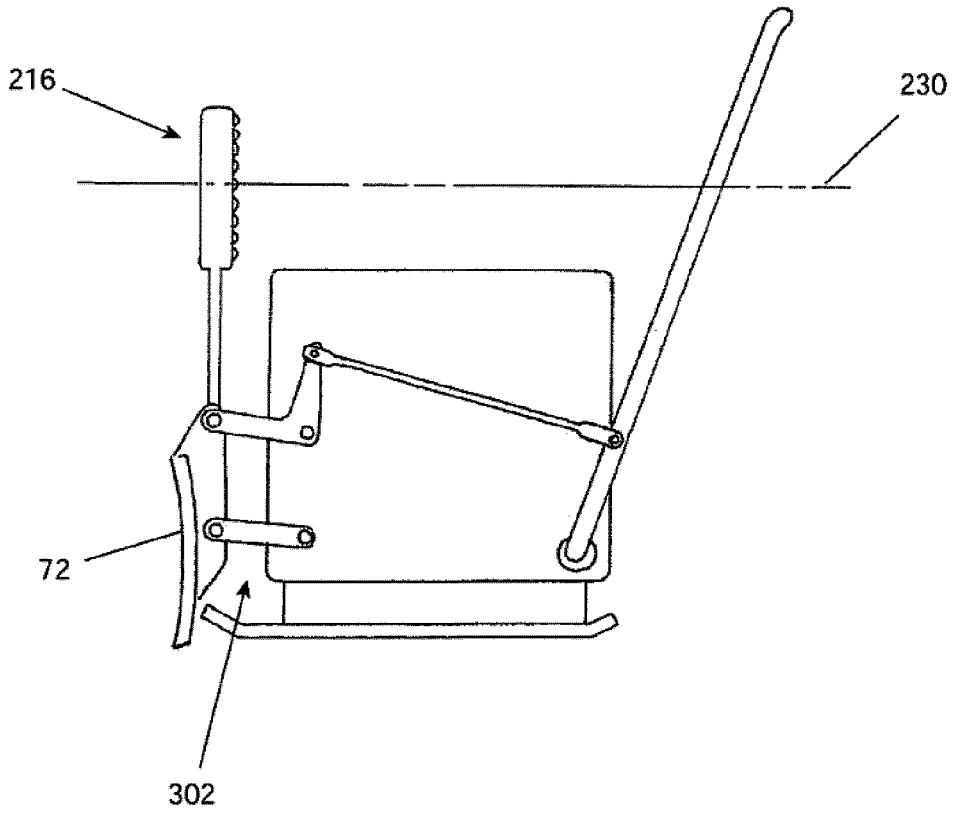
FIG. 21 is a side elevation view of an upper-mass-mounted double-spar handle-linked embodiment having the sensor/display component mounted on the grading blade.

FIG. 21 shows an upper-mass-mounted double-spar handle-linked embodiment 300 having the sensor/display component 216 mounted on the grading blade 72. With the lower-spar-mass pivot 306, lower-spar-blade pivot 308, upper-spar-mass pivot 312 and upper-spar-blade pivot 314 positioned so as to essentially define the four corners of a parallelogram (i.e., so that the lower spar 304 and upper spar 310 are functionally parallel and of equal length), the grading blade 72 does not tilt as it is raised or lowered, which is desirable with the sensor/display component 216 mounted on the grading blade 72, as the sensor/display component 216 maintains the same relative orientation (i.e., normal) to the plane defined by the vibratory plate 52 no matter the vertical position of the grading blade 72.

Figure 22:
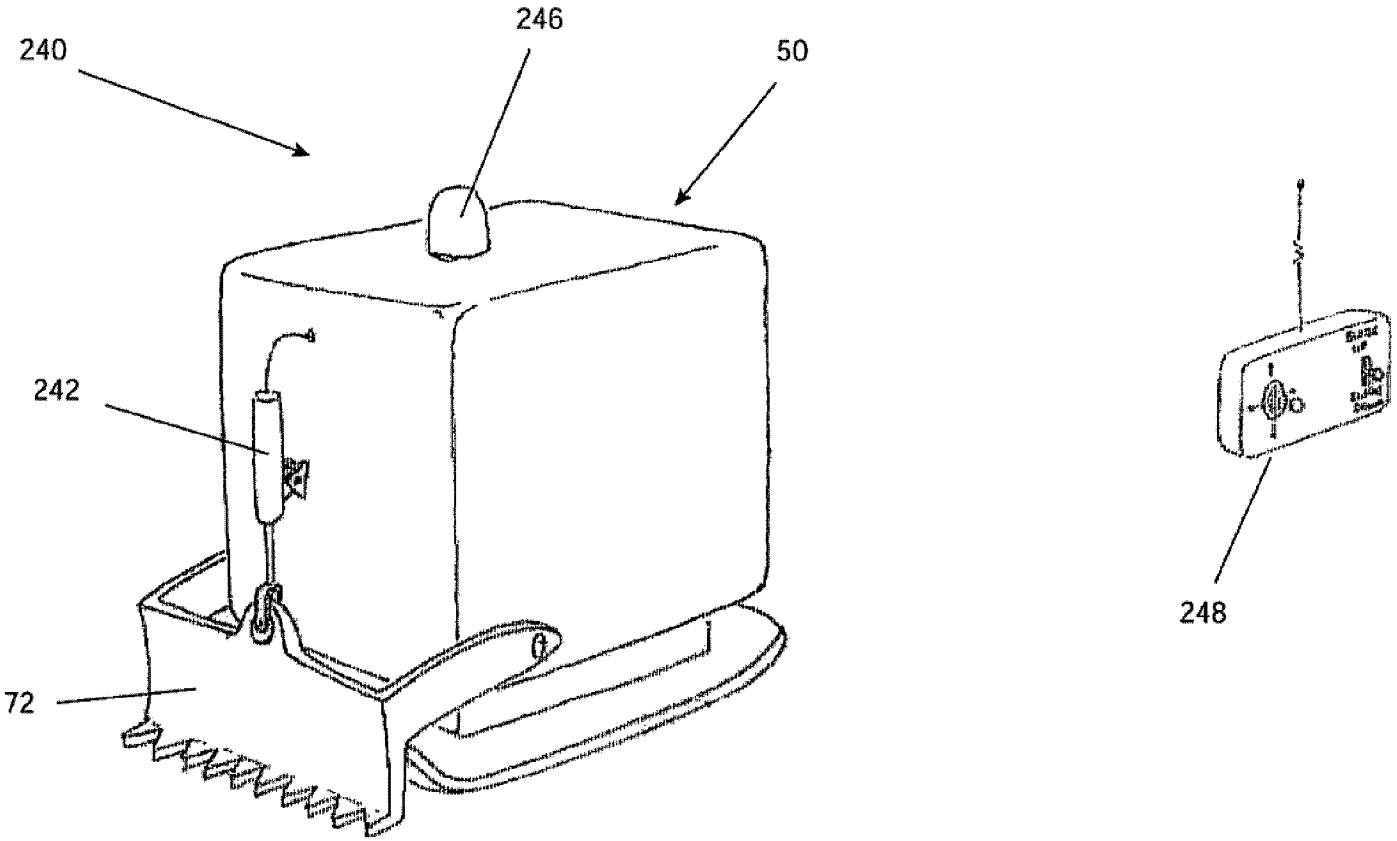
FIG. 22 shows components of a remote control system in association with an upper-mass-mounted embodiment of the present invention.
Figure 23:
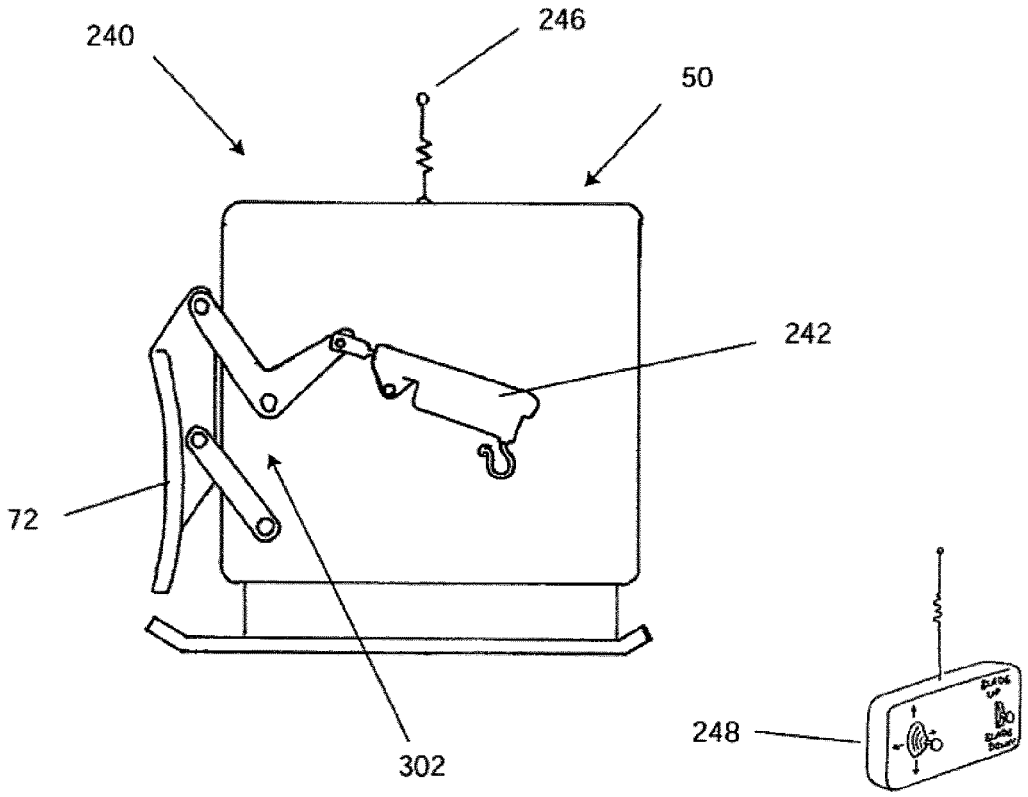
FIG. 23 shows components of a remote control system in association with an upper-mass-mounted double-spar embodiment of the present invention.

A remote control system 240 for use with embodiments of the present invention is shown in FIGS. 22 and 23. The remote control system 240 comprises a servo motor 242, a receiver 246 (connected to, among other things, the servo motor 242); and a control/transmitter 248 for use by an operator in sending instructions to raise or lower the grading blade 72, as well as to control other functions of the vibratory plate compactor 50. In the embodiment shown in FIG. 22, the servo motor 242 is connected to the top of the grading blade 72. In the embodiment shown in FIG. 23, the servo motor 242 is connected to the V-spar-link-arm connector 320 of a double-spar mounting assembly 302.

An automatic blade height adjuster (not shown) may be used with embodiments of the present invention, the automatic blade height adjuster comprising an array of laser sensors 222 interconnected with the servo motor 242, so as to automatically raise and lower the grading blade 72 responsive to the indications of vertical distance above or below the desired grade detected by the array of laser sensors 222.

It is understood that any of the embodiments described herein may require a modification of the mass of the plate compactor to preserve a desired relative centre of gravity of the vibrating plate and the upper mass.

What is claimed is:

1. A compactor for compacting soil, and having a vibratory plate and an upper mass connected to the vibratory plate and configured to provide vibrational movement of the vibratory plate relative to the upper mass, and having an operator handle for use in the directional control of the compactor, the improvement comprising:

a grading blade mounted to the compactor; and an adjustment means for upward and downward adjustment of the grading blade;

wherein the grading blade is mounted to the upper mass via a mounting assembly comprising:

two double-spar assemblies, one double-spar assembly on one side of the upper mass and the other double-spar assembly on an opposed side of the upper mass, each double-spar assembly comprising:

an upper spar pivotally connected to the upper mass at an upper spar mass pivot and pivotally connected to the grading blade at an upper spar blade pivot; and a lower spar pivotally connected to the upper mass at a lower spar mass pivot and pivotally connected to the grading blade at an upper spar blade pivot, wherein each upper spar mass pivot, upper spar blade pivot, lower spar mass pivot and upper spar blade pivot, has a pivot axis and the pivot axes of one double-spar assembly are aligned with the pivot axes of the other double-spar assembly.

2. The compactor of claim 1, wherein:

the grading blade has a front face and a tilt, the tilt being a general angular orientation of the front face relative to an imaginary plane defined by the vibratory plate; and the pivot axes are located such that the pivot axes intersect an imaginary plane normal to the pivot axes, at locations substantially defining the four corners of a parallelogram, whereby, the tilt remains substantially the same through a range of available upward and downward adjustment of the grading blade.

3. The compactor of claim 1, wherein the adjustment means comprises a control device mounted to the operator handle and an interconnection between the control device and the grading blade.

4. The compactor of claim 3, wherein the interconnection between the control device and the grading blade is a control cable.

5. The compactor of claim 1, wherein:

the operator handle is pivotally connected to the upper mass; and the adjustment means comprises a linkage between the operator handle and the grading blade, whereby pivoting the operator handle relative to the upper mass in one direction adjusts the grading blade upward and pivoting the operator handle relative to the upper mass in the other direction adjusts the grading blade downward.

6. The compactor of claim 1, wherein the grading blade is one of a straight blade, a serrated blade, a contained blade and a bucket blade.

7. The compactor of claim 1 configured for use with a rotary laser level, wherein the compactor comprises a sensor/display component having:

a substantially vertical linear array of laser sensors; and a display configured to indicate whether a laser sensed by the laser sensors is above, below or at a specified laser sensor.

8. The compactor of claim 7, wherein:

the sensor/display component is mounted to the grading blade.

9. The compactor of claim 1, wherein the adjustment means comprises:

a motor configured to effect upward and downward adjustment of the grading blade; and a receiver interconnected with the motor and configured for instructing the motor to effect upward and downward adjustment of the grading blade responsive to received signals.

10. The compactor of claim 9, further comprising a remote control/transmitter, wherein the received signals are transmitted by the remote control/transmitter.

11. The compactor of claim 9, configured for use with a rotary laser level, wherein:

the receiver comprises a substantially vertical linear array of laser sensors; and the received signals are sensed lasers, wherein in use:

if a sensed laser is above a specified laser sensor, the receiver instructs the motor to make an upward adjustment of the grading blade; and if a sensed laser is below a specified laser sensor, the receiver instructs the motor to make a downward adjustment of the grading blade.

12. The compactor of claim 1, wherein the grading blade has a front face and a tilt, the tilt being a general angular orientation of the front face relative to an imaginary plane defined by the vibratory plate, the compactor further comprising a tilt adjustment mechanism.

13. A compactor for compacting soil, and having a vibratory plate, an upper mass connected to the vibratory plate and an operator handle, and configured to provide vibrational movement of the vibratory plate relative to the upper mass, the improvement comprising:

a grading blade mounted to the upper mass via a mounting assembly comprising:

two double-spar assemblies, one double-spar assembly on one side of the upper mass and the other double-spar assembly on an opposed side of the upper mass, each double-spar assembly comprising:

an upper spar pivotally connected to the upper mass at an upper spar mass pivot and pivotally connected to the grading blade at an upper spar blade pivot; and a lower spar pivotally connected to the upper mass at a lower spar mass pivot and pivotally connected to the grading blade at an upper spar blade pivot, wherein each upper spar mass pivot, upper spar blade pivot, lower spar mass pivot and upper spar blade pivot, has a pivot axis and the pivot axes of one double-spar assembly are aligned with the pivot axes of the other double-spar assembly, wherein:

the grading blade has a front face and a tilt, the tilt being a general angular orientation of the front face relative to an imaginary plane defined by the vibratory plate; and the pivot axes are located such that the pivot axes intersect an imaginary plane normal to the pivot axes, at locations substantially defining the four corners of a parallelogram, whereby, the tilt remains substantially the same through a range of available upward and downward adjustment of the grading blade;

an adjustment means comprising a control device mounted to the operator handle and an interconnection between the control device and one of the mounting assembly and the grading blade.

* * * * *